US010767276B2

(12) United States Patent
Gengo et al.

(10) Patent No.: US 10,767,276 B2
(45) Date of Patent: Sep. 8, 2020

(54) METHOD AND DEVICE FOR REGENERATING A PLATINUM BATH

(71) Applicants: Safran Aircraft Engines, Paris (FR); Institut National Polytechnique de Toulouse, Toulouse (FR); Centre National de la Recherche Scientifique, Paris (FR)

(72) Inventors: Auriane Gengo, Moissy-Cramayel (FR); Sébastien Elgue, Baziege (FR); Laurent Prat, Toulouse (FR)

(73) Assignees: SAFRAN AIRCRAFT ENGINES, Paris (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 0 days.

(21) Appl. No.: 16/345,420

(22) PCT Filed: Oct. 17, 2017

(86) PCT No.: PCT/FR2017/052857
§ 371 (c)(1),
(2) Date: Apr. 26, 2019

(87) PCT Pub. No.: WO2018/078243
PCT Pub. Date: May 3, 2018

(65) Prior Publication Data

US 2019/0249327 A1 Aug. 15, 2019

(30) Foreign Application Priority Data

Oct. 27, 2016 (FR) ..... 16 60448

(51) Int. Cl.
*C25D 21/18* (2006.01)
*C25D 3/50* (2006.01)
(Continued)

(52) U.S. Cl.
CPC ..... *C25D 21/18* (2013.01); *C25D 3/50* (2013.01); *C25D 3/567* (2013.01); *C25D 21/12* (2013.01); *C25D 21/02* (2013.01)

(58) Field of Classification Search
CPC ..... C25D 21/18; C25D 3/50
See application file for complete search history.

(56) References Cited

U.S. PATENT DOCUMENTS 4,160,704 A * 7/1979 Kuo ..... C25B 1/46 205/211
6,113,769 A * 9/2000 Uzoh ..... C25D 21/18 204/237

(Continued)

FOREIGN PATENT DOCUMENTS

FR 2989694 10/2013

OTHER PUBLICATIONS

International Search Report dated Dec. 12, 2017, in International Application No. PCT/FR2017/052857 (4 pages).

*Primary Examiner* — Brian W Cohen
(74) *Attorney, Agent, or Firm* — Bookoff McAndrews, PLLC

(57) ABSTRACT

A method of regenerating a platinum bath by flow reaction, the method comprising the successive steps of:
drawing off fluid from the platinum bath by means of a draw-off flow;
complexing platinum by mixing together the draw-off flow and a regeneration solution flow containing platinum, mixing taking place in an intensified reactor; and
feeding the platinum bath with the mixture resulting from the platinum complexing step, by means of a regenerated bath flow;
all of these steps being performed as a continuous flow.

6 Claims, 1 Drawing Sheet

(51) Int. Cl.

| | |
|---|---|
| ***C25D 21/12*** | (2006.01) |
| ***C25D 3/56*** | (2006.01) |
| ***C25D 21/02*** | (2006.01) |

(56) References Cited

U.S. PATENT DOCUMENTS

| | | | | |
|---|---|---|---|---|
| 6,264,806 | B1 | 7/2001 | Kaufman et al. | |
| 6,521,112 | B1 | 2/2003 | Balisky | |
| 9,273,403 | B2 * | 3/2016 | Bulan | C25B 1/46 |
| 2003/0024821 | A1 | 2/2003 | Chopra | |
| 2004/0238373 | A1 * | 12/2004 | Kim | C25B 1/46<br>205/516 |
| 2015/0008119 | A1 | 1/2015 | Papapanayiotou et al. | |

* cited by examiner

METHOD AND DEVICE FOR REGENERATING A PLATINUM BATH

CROSS-REFERENCE TO RELATED APPLICATIONS

This application is the U.S. national phase entry under 35 U.S.C. § 371 of International Application No. PCT/FR2017/052857, filed on Oct. 17, 2017, which claims priority to French Patent Application No. 1660448, filed on Oct. 27, 2016.

FIELD OF THE INVENTION

The present disclosure relates to the field of platinum baths for making a platinum-based metal underlayer on a metal substrate, and more particularly it relates to a method of regenerating a platinum bath by flow reaction, and also to a device for regenerating a platinum bath.

STATE OF THE PRIOR ART

Superalloy turbine blade parts for a turbine engine are coated in a metal underlayer for providing the material with protection against oxidation and/or corrosion. Blade parts may also include a ceramic layer acting as a thermal barrier. The metal underlayer then serves to provide better adhesion of the ceramic layer on the blade part. The metal underlayer is made in particular by electrolytically depositing platinum that comes from a platinum bath. By way of example, a method of fabricating such a bath in order to make a platinum-based metal underlayer is described in patent FR2989694.

The use of platinum baths is nowadays relatively well understood. In order to form a metal underlayer, the platinum bath comprises one or more platinum complexes, which, under the effect of the electric current passing through the bath, become deposited on the metal part in order to form the metal underlayer.

Thus, as successive platinum underlayers are deposited on metal parts, the platinum complex content in the platinum bath decreases. Consequently, the concentration of platinum in complex form in the bath is not constant over time. The rate and the time of deposition are thus likewise not constant. It is therefore necessary for the platinum bath either to be replaced or else to be regenerated.

Given the cost of the compounds in the bath, and in particular of platinum, it is generally preferred to regenerate the platinum bath.

Thus, when the total platinum content in the bath reaches a predetermined lower limit, electrodeposition of platinum on metal parts is stopped and the platinum bath is regenerated.

Typically, such regeneration of the platinum bath is performed by adding platinum salts directly into the bath.

Nevertheless, because the composition of the platinum bath varies over time, in particular as a result of evaporation of certain chemical species that are present in the bath, and because the temperature of the platinum bath is generally different from the complexing temperature of platinum, not all of the platinum put into solution in the form of platinum salts becomes complexed.

Thus, regeneration step after regeneration step, the maximum content of platinum in complex form after regeneration decreases. When the content of platinum in complex form reaches a predetermined lower limit, the platinum bath is replaced.

Furthermore, the time required to dissolve and stabilize platinum salts in the bath is 24 hours (h) to 48 h. During that time, production, i.e. deposition of metal underlayers by depositing platinum, is interrupted. Consequently, that increases production times.

There thus exists the need to optimize this method of regenerating a platinum bath, serving in particular to no longer stop production, and to maintain deposition rate and time constant throughout the lifetime of the bath.

SUMMARY OF THE INVENTION

The present disclosure provides a method of regenerating a platinum bath by flow reaction, the method comprising the successive steps of:

- drawing off fluid from the platinum bath by means of a draw-off flow;
- complexing platinum by mixing together the draw-off flow and a regeneration solution flow containing platinum, mixing taking place in an intensified reactor; and
- feeding the platinum bath with the mixture resulting from the platinum complexing step, by means of a regenerated bath flow;
- all of these steps being performed as a continuous flow.

In the present disclosure, the assembly made up of the platinum bath, the draw-off flow, the reactor, and the regenerated bath flow forms a loop in which a fluid circulates. In the present disclosure, the term "fluid" designates the liquid flowing in said loop, whether in the platinum bath, in the draw-off flow prior to regeneration, in the reactor, or in the regenerated bath flow after regeneration.

In the present disclosure, the "draw-off flow" designates the fluid drawn from the platinum bath and flowing to the reactor, e.g. in a pipe. The "regeneration solution flow" designates a fluid having a predetermined platinum content flowing to the reactor independently of the above-defined circulation loop. The regeneration solution flow mixes with the draw-off flow in the reactor. The "regenerated bath flow" designates the fluid coming from the reactor as a result of mixing between the draw-off flow and the regeneration solution flow, and flowing towards the platinum bath, e.g. in a pipe.

The term "performed as a continuous flow" should be understood to mean that these steps (drawing off, complexing, feeding) constituting a regeneration cycle are performed in succession in such a manner that each fluid (draw-off flow, regeneration solution flow, regenerated bath flow) flows continuously and without interruption, in particular while mixing together in the reactor during the complexing step.

It can thus be understood that the regeneration method may be performed regardless of whether a platinum underlayer is in the process of being deposited.

The regeneration method may also be performed discontinuously. For example, it is possible to interrupt the regeneration method when no platinum underlayer is being deposited, i.e. as a function of the regeneration needs of the platinum bath, and the regeneration method may be stopped, or the regeneration method may be interrupted, while a platinum underlayer is being deposited. It can be understood that the regeneration method may be performed independently of whether a platinum underlayer is being deposited.

This method is possible because the step of complexing platinum, which enables the platinum bath to be regenerated, takes place in a specific reactor, which is an element distinct from said platinum bath and external thereto. This makes it possible to avoid interrupting production, i.e. the method of depositing a platinum underlayer, in order to fabricate the platinum complex.

For example, because of the small diameter of the channels making up an intensified reactor, the use of such a reactor can serve to perform mixing quickly and effectively (in only a few seconds), while presenting a small volume of draw-off fluid (and thus a small percentage of fluid drawn off from the platinum bath, which thus contains a generally constant quantity of fluid), and it enables very good temperature control to be achieved because of the presence of heating fluid. Furthermore, since the platinum bath is fed with platinum in the form of a platinum complex, the bath can be used to deposit platinum underlayers on a greater number of parts than would be possible if platinum was added in the form of salts directly into the bath.

In some embodiments, the step of complexing in the reactor comprises the steps of:

- preheating the draw-off flow and the regeneration solution flow so that their respective temperatures are equal to a predetermined temperature higher than the temperature of the platinum bath;
- mixing the draw-off flow with the regeneration solution flow so as to form a platinum complex; and
- thermal monitoring, for a predetermined time, of the mixture formed in the preceding step in order to ensure that the temperature of the mixture is equal to the predetermined temperature during the complexing step.

The complexing step, which takes place in the reactor, itself comprises at least three successive steps: independent preheating of the flows; mixing the flows together; and thermal monitoring of the resulting mixture. The preheating may be performed by a system of heat exchangers using a heating fluid. The step of thermal monitoring consists in conserving the temperature of the mixture at the predetermined value for a certain length of time, by measuring it and by regulating it, where necessary.

Platinum complex formation may be optimum at a predetermined temperature, e.g. in the range 80° C. to 90° C. Preheating the draw-off flow and the regeneration solution flow, independently of each other, enables those two fluids to be raised to the desired temperature before mixing them together, thereby forming the platinum complex. The thermal monitoring serves to ensure that the resulting mixture is indeed at the predetermined temperature, so that the platinum complex is indeed formed. By way of example, the temperature of the mixture may be measured at various locations in the reactor by using thermocouples.

In some embodiments, after the step of thermal monitoring, the mixture is returned to the temperature of the platinum bath in a tank located downstream from the reactor.

In the present disclosure, the terms "upstream" and "downstream" should be considered relative to the flow directions of the various flows.

After being kept hot, the mixture is returned to the temperature of the platinum bath in a tank. This step enables the temperature of the regenerated bath flow coming from the reactor and fed to the platinum bath to be the same as the temperature of the platinum bath. There is thus no need to interrupt the operation of the platinum bath in order to regulate it at the appropriate temperature. Specifically, in order to deposit a platinum underlayer, the temperature of the platinum bath is optimized for obtaining desired efficiency.

In some embodiments, the rate at which the reactor is fed with the draw-off flow is 80 grams per minute (g/min), and the rate at which the reactor is fed with the regeneration solution flow is 10 g/min.

These respective values for the rates at which the reactor is fed with the draw-off flow and with the regeneration solution flow enable the resulting mixture, and thus the flow of regenerated bath feeding the platinum bath, to possess the desired concentration of platinum complex.

In some embodiments, the concentration of platinum in the platinum bath is maintained continuously at a value lying in an interval of 1 gram per liter (g/L), preferably of 0.5 g/L, more preferably of 0.1 g/L. Feeding the platinum bath continuously with the regenerated bath flow enables the platinum bath to possess a concentration of platinum in complex form that lies within a given interval, and thus to maintain both deposition rate and deposition time constant.

In other words, the method enables the concentration of platinum in the bath to be maintained continuously at a constant value, e.g. to within 0.1 g/L. Since the concentration of platinum in the bath is maintained continuously at the desired value, this makes it possible to perform platinum underlayer deposition without any need to interrupt deposition in order to regenerate the bath. Production yield is thus improved. Furthermore, deposition rate and time can thus be constant throughout the lifetime of the platinum bath.

In some embodiments, the temperature of the platinum bath is maintained at a value lying in an interval of 4° C., preferably of 2° C., more preferably of 1° C., e.g. by means of a system of heating resistance elements.

The present disclosure also provides a device for regenerating a platinum bath in a continuous flow, the device comprising:

- a platinum bath;
- an intensified reactor fed with a draw-off flow coming from the platinum bath and with a regeneration solution flow containing platinum, in order to form a platinum complex; and
- a regenerated bath flow from the reactor and feeding the platinum bath with the platinum complex.

In the present disclosure, the assembly made up of the platinum bath, the draw-off flow, the intensified reactor, and the regenerated bath flow forms a loop in which a fluid circulates. Since the intensified reactor is an element that is distinct from the platinum bath and external thereto, this device serves to regenerate said platinum bath by forming the platinum complex in the intensified reactor. The platinum bath thus remains available, which thus makes it possible to avoid interrupting the production of platinum underlayers. Furthermore, the device enables a relatively constant concentration of platinum to be maintained in the bath, thus enabling deposition rate and time to be maintained constant throughout the lifetime of the bath.

In some embodiments, the mixing between the draw-off flow and the regeneration solution flow in the intensified reactor takes place using a module having one flow conveying the mixture and at least one flow conveying a heating fluid.

By way of example, this module may be in the form of a superposition of plates with the various flows flowing separately between them. This enables effective mixing to be performed between the two fluids while also regulating their temperature, and thus the temperature of the resulting mixture, to the desired temperature.

In some embodiments, the mixing between the draw-off flow and the regeneration solution flow in the intensified reactor is performed using a mixer.

By way of example, the mixer may be a T-coupling, possibly having a flow diameter of one-quarter of an inch. This type of mixture presents the advantage of being simple, lightweight, and inexpensive, and of achieving effective mixing between the two fluids.

In some embodiments, the mixer is a Y-coupler.

BRIEF DESCRIPTION OF THE DRAWING

The invention and its advantages can be better understood on reading the following description of various implementations of the invention given as non-limiting examples. The description refers to the accompanying sheet of figures, in which.

DETAILED DESCRIPTION OF EMBODIMENTS

Figure 1:
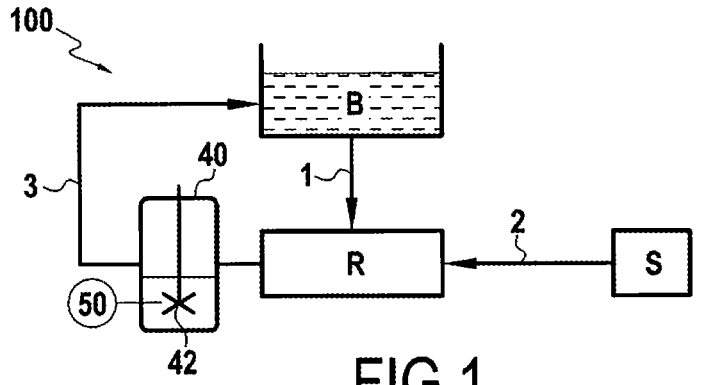
FIG. 1 is a block diagram of a device in accordance with the present disclosure for regenerating a platinum bath.

FIG. 1 is a block diagram of a device 100 of the present disclosure for regenerating a platinum bath. The device 100 comprises a platinum bath B filled at least in part with a fluid including one or more platinum complexes suitable for forming a metal underlayer. Under the effect of the electric current passing through the bath, the platinum complexes become deposited on the metal part, e.g. a turbine engine blade part, so as to form the metal underlayer.

For example, in order to fabricate one liter of platinum bath B having 8 g/L of platinum, the procedure is as follows:

Preparing a solution B': in 300 milliliters (mL) of distilled water (<500 ohms (0)) at 30° C., adding 44.0 grams (g) of diammonium hydrogen phosphate having the chemical formula $(NH_4)_2HPO_4$ (i.e. 0.33 moles) and 75.0 g of ammonium dihydrogen phosphate of chemical formula $NH_4H_2PO_4$ (i.e. 0.65 moles). The molar ratio between the quantity of ammonium dihydrogen phosphate and the quantity of diammonium hydrogen phosphate is 2. Once the salts have dissolved, covering the solution and raising it to 50° C. over 4 h 30 min.

Preparing a solution A': in 300 mL of distilled water at 45° C., adding 5 g of sodium hydroxide of chemical formula NaOH (i.e. 0.080 moles) and 18.3 g of diammonium hexachloroplatinate platinum salt of formula $(NH_4)_2PtCl_6$ (i.e. 0.040 moles). The molar ratio between the quantity of sodium hydroxide and the diammonium hexachloro-platinate salt is 2. Allowing the platinum salts to dissolve within solution A'.

Once the solution B' is ready and hot, preparing the solution A' and adding it to the solution B' previously raised to 60° C.

To finish, taking the mixture A'+B' (of pH previously adjusted to 6.3 by adding a basic solution, such as, for example, sodium hydroxide, potassium hydroxide, or sodium triphosphate) and raising it to 85° C. over 3 h. All of the solutions are covered throughout the heating steps.

More generally, with this solution B' containing diammonium hydrogen phosphate of chemical formula $(NH_4)_2HPO_4$ and ammonium dihydrogen phosphate of chemical formula $NH_4H_2PO_4$, setting the pH of the mixture of solutions A'+B' to lie in the range 6 to 10, and preferably in the range 6 to 7.

The device 100 also has a draw-off flow 1 flowing in a first pipe, a regeneration solution flow 2 flowing in a second pipe, and an intensified reactor R. The platinum bath B and the intensified reactor R are connected together by the draw-off flow 1. The draw-off flow 1 takes a portion of the platinum bath B for regenerating and conveys it to the intensified reactor R, e.g. at a rate of 80 g/min. A bath of regeneration solution S is connected to the intensified reactor R by the regeneration solution flow 2. The regeneration solution bath S has platinum at a concentration of 10.5 g/L. This concentration corresponds to the regeneration solution flowing at 10 g/min. The regeneration solution flow 2 takes a portion of the regeneration solution bath S and conveys it to the intensified reactor R. The draw-off flow 1 and the regeneration solution flow 2 then mix in the intensified reactor R.

A regenerated bath flow 3 flows in a third pipe, and connects the intensified reactor R to the platinum bath B. The mixture of the draw-off flow 1 mixed with the regeneration solution flow 2 and coming from the intensified reactor R, is then conveyed to the platinum bath B.

The assembly constituted by the platinum bath B, the draw-off flow 1, the intensified reactor R, and the regenerated bath flow 3 forms a loop for circulating the platinum bath, going from a "bath for regeneration" state in the draw-off flow 1, to a "regenerated bath" state in the regenerated bath flow 3.

Figure 3:
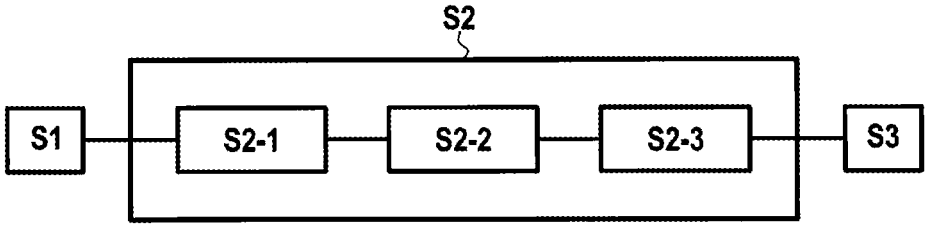
FIG. 3 shows the various steps of a method of the present disclosure for regenerating a platinum bath.

The regeneration of the platinum bath B takes place outside the bath, during the step S2 in the intensified reactor R, with its operating principles shown diagrammatically in FIG. 3.

The intensified reactor R may be an intensified reactor made up in particular of a plurality of modules. Each of the modules has four glass plates that are superposed on one another, and brazed together, for example, with the various flows, including a heating fluid flow, flowing separately between them. The channels formed between the plates, in which the various flows flow, possess flow diameters in the range 0.5 mm to 20 mm. This serves in particular to enable heat to be transferred effectively. The intensified reactor R thus has a first preheater module 10*a* for preheating the draw-off flow 1, and a second preheater module 10*b* for preheating the regeneration solution flow 2. The preheater modules 10*a* and 10*b* each have an inlet and an outlet.

In this example, in order to optimize formation of the platinum complex, the mixing temperature between the flows is set at 80° C., the flow rate of the draw-off flow 1 feeding the first preheater module 10*a* is set at 80 g/min, and the flow rate of the regeneration solution flow 2 feeding the second preheater module 10*b* is set at 10 g/min. The first preheater module 10*a* thus serves to preheat the draw-off flow 1 so as to raise its temperature to at least 80° C., while remaining below 90° C. The second preheater module 10*b* serves to preheat the regeneration solution flow 2 so as to raise its temperature to at least 80° C., while remaining below 90° C. A heating fluid flows between the plates of the first and second modules 10*a* and 10*b* in order to raise the mixing temperature to this value lying in the range 80° C. to 90° C.

The outlets from the first and second preheater modules 10*a* and 10*b* are connected to a mixer 20 in which the draw-off flow 1 and the regeneration solution flow 2 are mixed together, thereby forming the platinum complex. In this example, the mixer 20 is a module comprising four plates of glass brazed together with the two flows flowing in particular between them and mixing together, the module having two inlets and one outlet. The first inlet of the mixer 20 is fed with the preheated draw-off flow 1 and the second inlet of the mixer 20 is fed with the preheated regeneration solution flow 2. The outlet from the mixer 20 delivers the resulting mixture. A heating fluid also flows between those plates, so as to maintain the temperature of the mixture at a value higher than 80° C. and lower than 90° C.

Alternatively, the mixer 20 may be a continuous mixer, e.g. a T-coupling, having a flow diameter of one-quarter of an inch, and in which a first inlet is fed with the preheated draw-off flow 1, a second inlet is fed with the preheated regeneration solution flow 2, and an outlet delivers the resulting mixture.

Figure 2:
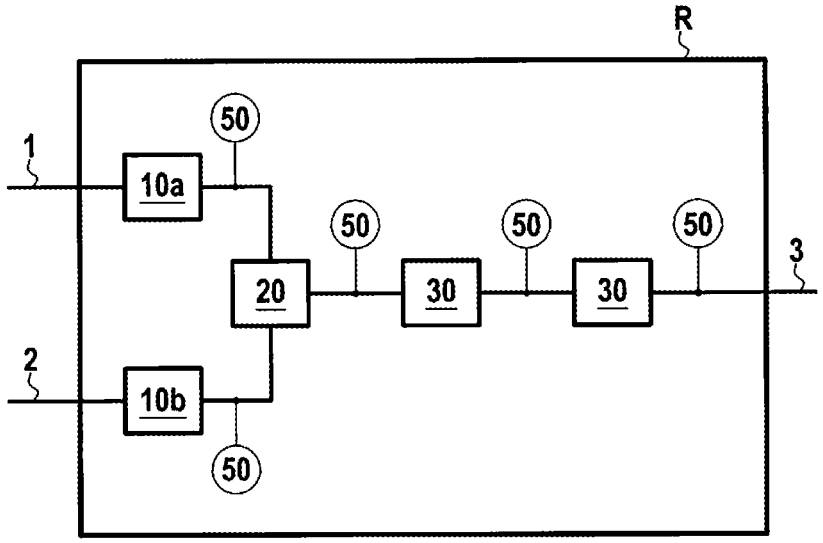
FIG. 2 is a block diagram of an intensified reactor in accordance with the present disclosure.

The mixture leaving the mixer 20 thus includes the reformed platinum complex. The transit time through the reactor R for the mixture leaving the mixer 20 is set to a predetermined value, e.g. 6 seconds (s). In FIG. 2, the reactor R has one or two control modules 30, analogous to the preheater modules 10*a* and 10*b* and connected in series, through which the mixture coming from the mixer 20 flows. These control modules 30 serve to increase the transit time of the mixture at 80° C. through the reactor R, thereby finishing off the complexing of the mixture, where necessary. The reactor could equally well not have any control module 30, or it could have only one or it could have more than two.

The reactor R also has temperature-measuring means 50, possibly being thermocouples, arranged at the outlets from the first and second preheater modules 10*a* and 10*b*, from the mixer 20, and from each pipe module 30. These temperature-measuring means 50 serve to monitor the temperature of the fluid at various points. In particular, the temperature-measuring means 50 located downstream from the mixer 20 in the flow direction of the fluid serve to ensure that the temperature of the mixture is a temperature of 80° C., so that the platinum complex is properly formed. A thermostat may also be arranged at the outlet from the mixer, in order to regulate the temperature of the mixture.

A tank 40 in which the mixture is stored temporarily is located downstream from the reactor R. Since the formation of the platinum complex has been completed, this tank serves, e.g. by means of a cooling thermostat, to readjust the temperature of the mixture to the temperature of the platinum bath B. Thus, the flow of regenerated bath 3 leaving the reactor R passing through the tank 40 and feeding the platinum bath B is at the optimum temperature for depositing a platinum underlayer on the metal parts. The temperature of the platinum bath B for forming the underlayers lies in the range 62° C. to 66° C., and preferably in the range 63° C. to 65° C., more preferably in the range 63.5° C. to 64.5° C. In this example, the temperature of the regenerated bath flow in the tank 40 is lowered from 80° C. to 64° C. The tank 40 may also include a mixer 42 for making the temperature of the mixture uniform. Temperature-measuring means 50 such as a thermocouple may also be arranged in the tank 40 in order to monitor the temperature of said tank.

Furthermore, any evaporation from the platinum bath B is compensated by the fluid coming from the regeneration solution bath S or by adding water to the platinum bath B. The method of regenerating the platinum bath by flow reaction, using the device 100, is described below with reference to FIG. 3.

The method comprises a step S1 of drawing off fluid from the platinum bath B, a complexing step S2, by mixing together the draw-off flow 1 and the regeneration solution flow 2 in the reactor R, and a step S3 of feeding the platinum bath B with the mixture coming from the complexing step S2.

Furthermore, the complexing step S2 comprises various substeps performed in the reactor R. A preheating step S2-1 in which the draw-off flow 1 and the regeneration solution flow 2 are preheated to 80° C. independently of each other in the respective preheater modules 10*a* and 10*b*. A mixing step S2-2 in which the draw-off flow 1 and the regeneration solution flow 2 are mixed together in the mixer 20. A thermal monitoring step S2-3 in which the temperature of the mixture resulting from step S2-2 is controlled so as to ensure that it is equal to 80° C.

In this example, in order to deposit underlayers of platinum on metal parts, the concentration of platinum in the platinum bath B is maintained overall in the range 7.5 g/L to 8.5 g/L, i.e. within an interval of 1 g/L, preferably in the range 7.7 g/L to 8.3 g/L, more preferably in the range 7.9 g/L to 8.1 g/L. The above-described method is performed so that the concentration of platinum remains within this range of values. Thus, the method can be performed simultaneously with depositing platinum underlayers, such that production is thus not interrupted while regeneration is taking place, or the method can be performed while no deposition of platinum underlayers is taking place. The method may equally well be interrupted depending on production requirements. Furthermore, since the concentration of platinum is generally constant within the platinum bath, the time and the rate of platinum underlayer deposition can also be constant.

Although the present invention is described with reference to specific embodiments, it is clear that modifications and changes may be carried out on those examples without going beyond the general ambit to the invention as defined by the claims. In particular, individual characteristics of the various embodiments shown and/or mentioned may be combined in additional embodiments. Consequently, the description and the drawings should be considered in a sense that is illustrative rather than restrictive. For example, it is possible to omit the tank 40.

It is also clear that all of the characteristics described with reference to a method are transposable, singly or in combination, to a device, and conversely that all of the characteristics described with reference to a device can be transposed, singly or in combination, to a method.

The invention claimed is:

1. A method of regenerating a platinum bath by flow reaction, the method comprising the successive steps of:

drawing off fluid from the platinum bath by means of a draw-off flow;

complexing platinum by mixing together the draw-off flow and a regeneration solution flow containing platinum, mixing taking place in an intensified reactor, wherein the step of complexing in the reactor comprises the steps of:

preheating the draw-off flow and the regeneration solution flow so that their respective temperatures are equal to a predetermined temperature higher than the temperature of the platinum bath;

mixing the draw-off flow with the regeneration solution flow so as to form a platinum complex; and feeding the platinum bath with the mixture resulting from the platinum complexing step, by means of a regenerated bath flow;

all of these steps being performed as a continuous flow.

2. A method according to claim 1, further comprising:

thermal monitoring, for a predetermined time, of the mixture formed in the complexing step in order to ensure that the temperature of the mixture is equal to the predetermined temperature during the complexing step.

3. A method according to claim 2, wherein, after the step of thermal monitoring, the mixture is returned to a temperature of 64° C. in a tank located downstream from the reactor.

4. A method according to claim 1, wherein the rate at which the reactor is fed with the draw-off flow is 80 g/min, and the rate at which the reactor is fed with the regeneration solution flow is 10 g/min.

5. A method according to claim 1, wherein the concentration of platinum in the platinum bath is maintained continuously at a value lying in an interval of 1 g/L.

6. A method according to claim 1, wherein the temperature of the platinum bath is maintained at a value lying in an interval of 4° C.

* * * * *